US010770031B2

(12) United States Patent
Yin

(10) Patent No.: US 10,770,031 B2
(45) Date of Patent: Sep. 8, 2020

(54) DISPLAY CORRECTION METHOD AND DISPLAY CORRECTION SYSTEM

(71) Applicant: BOE Technology Group Co., Ltd., Beijing (CN)

(72) Inventor: Xinshe Yin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 58 days.

(21) Appl. No.: 16/330,225

(22) PCT Filed: Mar. 16, 2018

(86) PCT No.: PCT/CN2018/079303
§ 371 (c)(1),
(2) Date: Mar. 4, 2019

(87) PCT Pub. No.: WO2018/214622
PCT Pub. Date: Nov. 29, 2018

(65) Prior Publication Data

US 2019/0206365 A1 Jul. 4, 2019

(30) Foreign Application Priority Data

May 23, 2017 (CN) ..... 2017 1 0369420

(51) Int. Cl.
*G09G 5/10* (2006.01)
*G09G 3/34* (2006.01)
*G09G 5/06* (2006.01)

(52) U.S. Cl.
CPC ..... *G09G 5/10* (2013.01); *G09G 3/3406* (2013.01); *G09G 5/06* (2013.01);
(Continued)

(58) Field of Classification Search
None
See application file for complete search history.

(56) References Cited

U.S. PATENT DOCUMENTS 6,795,053 B1 * 9/2004 Funamoto ..... G09G 3/3611 345/102
2014/0098079 A1 * 4/2014 Takayanagi ..... G09G 3/3426 345/207
2019/0206365 A1 7/2019 Yin

FOREIGN PATENT DOCUMENTS

CN 202584681 U 12/2012
CN 104681007 A 6/2015
(Continued)

OTHER PUBLICATIONS

International Search Report and Written Opinion (including English translation of Search Report and Box V of Written Opinion) for International Application No. PCT/CN2018/079303, dated Jun. 15, 2018, 10 pages.

*Primary Examiner* — Parul H Gupta
(74) *Attorney, Agent, or Firm* — Westman, Champlin & Koehler, P.A.

(57) ABSTRACT

The present disclosure provides a display correction method and a display correction system. The method is used by the display correction system to correct display performance of a display, wherein the display correction system includes an automatic adjustment apparatus and a light detection apparatus. The method includes: acquiring, by the light detection apparatus, an optical signal emitted by the display, determining a first brightness value according to the optical signal, and transmitting the first brightness value to the automatic adjustment apparatus; in response to determining that the first brightness value is different from a first standard brightness value preset for the display, adjusting, by the automatic adjustment apparatus, the brightness value of the display to the first standard brightness value; and triggering, by the automatic adjustment apparatus, a brightness sensor in the display to detect brightness of the display, and in response to determining that a second brightness value
(Continued)

detected by the brightness sensor is different from a second standard brightness value preset for the brightness sensor, correcting the second standard brightness value of the brightness sensor to the second brightness value.

20 Claims, 6 Drawing Sheets

(52) U.S. Cl.
CPC ..... *G09G 2320/0626* (2013.01); *G09G 2320/0666* (2013.01); *G09G 2320/0673* (2013.01); *G09G 2330/12* (2013.01); *G09G 2360/16* (2013.01); *G09G 2380/08* (2013.01)

(56) References Cited

FOREIGN PATENT DOCUMENTS

| | | | |
|---|---|---|---|
| CN | 105810157 | A | 7/2016 |
| CN | 105959491 | A | 9/2016 |
| CN | 106354467 | A | 1/2017 |
| CN | 106940993 | A | 7/2017 |

* cited by examiner

DISPLAY CORRECTION METHOD AND DISPLAY CORRECTION SYSTEM

CROSS-REFERENCE TO RELATED APPLICATION(S)

This application claims priority to the PCT Application No. PCT/CN2018/079303, filed on Mar. 16, 2018, entitled "DISPLAY CORRECTION METHOD AND DISPLAY CORRECTION SYSTEM", which published as WO 2018/214622 A1 on Nov. 29, 2018, and claims priority to the Chinese Patent Application No. 201710369420.0, filed on May 23, 2017, entitled "DISPLAY CORRECTION METHOD AND DISPLAY CORRECTION SYSTEM", which are incorporated herein by reference in their entireties.

TECHNICAL FIELD

The present disclosure relates to the field of display technologies, and more particularly, to a display correction method and a display correction system.

BACKGROUND

The rapid development of digital imaging devices and images for medical use has led to the conversion of image diagnosis from conventional hard-readable films such as photographic films to soft-readable films such as displays, and the photographic films have been replaced with medical displays as a main tool for image diagnosis. As a special display in the medical field, a medical display is required to satisfy the requirements of displays for stability, in addition to the general performance of general displays, such as high brightness, high contrast, high resolution, large size and high grayscale etc. The stability may comprise consistency and integrity. The consistency of the display requires that the same image on the display has the same display quality, such as brightness, grayscale, and contrast etc. when the medical display is used in different periods. The integrity of the display refers to that the same image displayed at workstations at different places has completely the same brightness, grayscale, contrast, etc. In order to achieve the above performance, the medical display needs to have a Digital Imaging and Communications in Medicine (DICOM) correction function and a brightness stability automatic control function.

In order to realize the brightness stability automatic control function of the medical display, a brightness stability control apparatus may be mounted in the display, and the brightness stability control apparatus mainly comprises a brightness sensor and a backlight stability control module. After the brightness sensor detects that a brightness value of the display does not satisfy a standard brightness value preset for the brightness sensor, the backlight stability control module performs an adjustment operation to adjust the brightness of the display according to a difference between the detected brightness value and the preset standard brightness value. For example, after a medical liquid crystal display with a light-emitting diode as a backlight source operates for a long time, brightness characteristics of the light-emitting diode may change. After a brightness value detected by the brightness sensor is less than a standard brightness value preset for the brightness sensor, the backlight stability control module may perform an adjustment operation to increase the brightness of the light-emitting diode.

Although the brightness of the display is adjusted under control of the backlight stability control module, the brightness value detected by the brightness sensor is inaccurate, and thus the brightness of the display adjusted by the backlight stability control module still does not satisfy the standard brightness preset for the display. Therefore, the display cannot maintain stable display performance during long-term use.

SUMMARY

In one aspect, there is provided a display correction method for correcting display performance of a display by a display correction system, the display correction system comprising an automatic adjustment apparatus and a light detection apparatus, the method comprising:

acquiring, by the light detection apparatus, an optical signal emitted by the display, determining a first brightness value according to the optical signal, and transmitting the first brightness value to the automatic adjustment apparatus;

in response to determining that the first brightness value is different from a first standard brightness value preset for the display, adjusting, by the automatic adjustment apparatus, the brightness value of the display to the first standard brightness value; and triggering, by the automatic adjustment apparatus, a brightness sensor in the display to detect brightness of the display, and in response to determining that a second brightness value detected by the brightness sensor is different from a second standard brightness value preset for the brightness sensor, correcting the second standard brightness value of the brightness sensor to the second brightness value.

In some embodiments, the display further comprises a backlight stability control module and a backlight driving panel, and the step of, in response to determining that the first brightness value is different from the first standard brightness value preset for the display, adjusting, by the automatic adjustment apparatus, a brightness value of the display to the first standard brightness value comprises:

in response to determining that the first brightness value is different from the first standard brightness value, controlling, by the automatic adjustment apparatus, the backlight stability control module in the display to adjust a duty ratio of a high-level pulse of the backlight driving panel or current of a backlight source, so that the brightness value of the display reaches the first standard brightness value.

In some embodiments, after correcting the second standard brightness value of the brightness sensor to the second brightness value, the method further comprises:

acquiring, by the light detection apparatus, optical signals emitted by the display when test images at various grayscales are displayed by the display, and determining corresponding brightness values according to various optical signals; and performing, by the automatic adjustment apparatus, Gamma testing and Gamma correction on the display according to the brightness values corresponding to the test images at various grayscales transmitted by the light detection apparatus.

In some embodiments, after correcting the second standard brightness value of the brightness sensor to the second brightness value, the method further comprises:

acquiring, by the light detection apparatus, optical signals emitted by the display when test images at various grayscales are displayed by the display, and determining corresponding color data according to various optical signals; and performing, by the automatic adjustment apparatus, color temperature testing and color temperature correction on the display according to the color data corresponding to the test images at various grayscales transmitted by the light detection apparatus.

In some embodiments, the light detection apparatus comprises a light detection head and a colorimeter; and the step of acquiring, by the light detection apparatus, an optical signal emitted by the display, determining a first brightness value according to the optical signal, and transmitting the first brightness value to the automatic adjustment apparatus comprises:

acquiring, by the light detection head, the optical signal emitted by the display, and transmitting the acquired optical signal to the colorimeter; and determining, by the colorimeter, the first brightness value of the optical signal and transmitting the first brightness value to the automatic adjustment apparatus.

In some embodiments, before the light detection apparatus acquires the optical signal emitted by the display, the method further comprises:

transmitting, by the automatic adjustment apparatus, an image test instruction to the display, and retrieving, by the display, a test image corresponding to the image test instruction from a plurality of pre-stored test images and displaying the test image.

In some embodiments, the test image which is retrieved and displayed according to the image test instruction is a test image at the highest grayscale.

In some embodiments, before, in response to determining that a second brightness value detected by the brightness sensor is different from a second standard brightness value preset for the brightness sensor, correcting the second standard brightness value of the brightness sensor to the second brightness value, the method further comprises:

receiving, from the display, the second standard brightness value set for the brightness sensor which is stored in a standard brightness value memory of the display.

In some embodiments, the step of, in response to determining that a second brightness value detected by the brightness sensor is different from a second standard brightness value preset for the brightness sensor, correcting the second standard brightness value of the brightness sensor to the second brightness value comprises:

in response to determining that the second brightness value detected by the brightness sensor is different from the second standard brightness value, triggering the display to replace the second standard brightness value stored in the standard brightness value memory with the second brightness value.

In some embodiments, the light detection head is placed at a center of a display screen of the display.

In another aspect, there is further provided a display correction system for correcting display performance of a display, the display correction system comprising an automatic adjustment apparatus and a light detection apparatus, wherein the light detection apparatus is placed at a preset position of the display, and is configured to acquire an optical signal emitted by the display, determine and acquire a first brightness value according to the optical signal, and transmit the first brightness value to the automatic adjustment apparatus; and the automatic adjustment apparatus is communicatively connected to the light detection apparatus, and is configured to:

in response to determining that the first brightness value is different from a first standard brightness value preset for the display, adjust the brightness value of the display to the first standard brightness value;

trigger a brightness sensor in the display to detect brightness of the display, and in response to determining that a second brightness value detected by the brightness sensor is different from a second standard brightness value preset for the brightness sensor, correct the second standard brightness value of the brightness sensor to the second brightness value.

In some embodiments, the display further comprises a backlight stability control module and a backlight driving panel, and the automatic adjustment apparatus is configured to:

in response to determining that the first brightness value is different from the first standard brightness value, control the backlight stability control module in the display to adjust a duty ratio of a high-level pulse of the backlight driving panel or current of a backlight source, so that the brightness value of a display screen reaches the first standard brightness value.

In some embodiments, the automatic adjustment apparatus is configured to:

receive, from the display, the second standard brightness value set for the brightness sensor which is stored in a standard brightness value memory of the display, and in response to determining that the second brightness value detected by the brightness sensor is different from the second standard brightness value, trigger the display to replace the second standard brightness value stored in the standard brightness value memory with the second brightness value.

In some embodiments, the light detection apparatus is further configured to acquire optical signals emitted by the display when test images at various grayscales are displayed by the display, and determine corresponding brightness values and/or color data according to various optical signals; and the automatic adjustment apparatus comprises a Gamma correction unit and/or a color temperature correction unit, wherein the Gamma correction unit is configured to perform Gamma testing and Gamma correction on the display in response to receiving the brightness values corresponding to the test images at various grayscales transmitted by the light detection apparatus; and the color temperature correction unit is configured to perform color temperature testing and color temperature correction on the display in response to receiving the color data corresponding to the test images at various grayscales transmitted by the light detection apparatus.

In some embodiments, the automatic adjustment apparatus further comprises a test program storage module, wherein the automatic adjustment apparatus is configured to: in response to that the automatic adjustment apparatus has performed the testing and the correction on the display, invoke test programs stored in the test program storage module to perform testing on the display performance of the display.

In some embodiments, the light detection apparatus comprises a light detection head and a colorimeter, wherein the light detection head is configured to acquire an optical signal emitted by the display, and transmit the acquired optical signal to the colorimeter; and the colorimeter is configured to determine a first brightness value of the optical signal and transmit the first brightness value to the automatic adjustment apparatus.

In some embodiments, the light detection head is placed at a center of the display screen of the display.

In some embodiments, the automatic adjustment apparatus transmits an image test instruction to an instruction register in the display, and the display retrieves a required test image from a plurality of pre-stored test images and displays the test image on the display.

In some embodiments, the automatic adjustment apparatus is mounted in the display.

BRIEF DESCRIPTION OF THE ACCOMPANYING DRAWINGS

DETAILED DESCRIPTION

Figure 1:
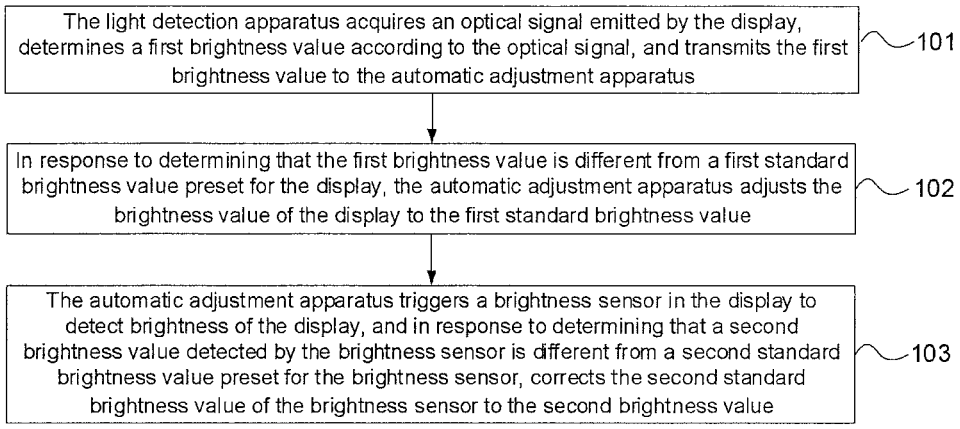
FIG. 1 is an exemplary flowchart of a display correction method according to an embodiment of the present disclosure.

In order to make the above purposes, features and advantages of the present disclosure more obvious and understandable, the present disclosure will be further described in detail below in conjunction with the accompanying drawings and the detailed description.

In the description of the present disclosure, "a plurality of" means two or more unless otherwise stated; and orientation or positional relationships indicated by the terms "upper", "lower", "left", "right", "inside", "outside" etc. are based on orientation or positional relationships shown in the accompanying drawings, are merely for the convenience of the description of the present disclosure and the simplification of the description, do not indicate or imply that a structure or element referred to must have a specific orientation or must be constructed or operate in a specific orientation, and therefore cannot be understood as limiting the present disclosure.

In the description of the present disclosure, it should be illustrated that unless otherwise explicitly defined and stipulated, the terms "mounted", "connected with", and "connected to" are to be understood broadly, for example, fixedly connected, or detachably connected, or integrally connected; or mechanically connected or electrically connected; or directly connected or indirectly connected through an intermediate medium. Specific meanings of the above terms in the present disclosure may be understood by those skilled in the art according to specific situations.

The detailed description of the present disclosure will be further described in detail below with reference to the accompanying drawings and the embodiments. The following embodiments are intended to illustrate the present disclosure, but are not intended to limit the scope of the present disclosure.

A brightness stability control apparatus is usually mounted in a medical display, and the brightness stability control apparatus is configured to control brightness of the display. The brightness stability control apparatus mainly comprises a brightness sensor and a backlight stability control module. A standard brightness value set for the brightness sensor is pre-stored in the display. When a brightness value detected by the brightness sensor is the same as the preset standard brightness value, it indicates that current brightness of the display is standard brightness; and after the brightness sensor detects that the brightness value of the display is different from the standard brightness value preset for the brightness sensor, the backlight stability control module adjusts the brightness of the display according to a difference between the detected brightness value and the preset standard brightness value, so that the display is finally under the standard brightness.

However, in a process of using the display, if a poor phenomenon of the brightness sensor occurs, for example, the brightness sensor is aging etc., the brightness value detected by the brightness sensor is inaccurate, and thus the brightness of the display adjusted by the backlight stability control module still does not satisfy the standard brightness preset for the display. It has been found that when other components of the display are abnormal, for example, other components are aging, deform etc., the above abnormal conditions may also cause the brightness value detected by the brightness sensor to be inaccurate, and thus the brightness of the display adjusted by the backlight stability control module still does not satisfy the standard brightness preset for the display.

In at least some embodiments of the present disclosure, in order to at least partially solve or alleviate the above problem, there is provided a display correction system for correcting display performance of a display, and specifically for correcting a standard brightness value preset for a brightness sensor in the display, to ensure that the brightness of the display satisfies the requirements for the brightness preset for the display. The display correction system according to some embodiments of the present disclosure may comprise an automatic adjustment apparatus and a light detection apparatus. Based on the structure of the display correction system described above, some embodiments of the present disclosure further propose a display correction method.

FIG. 1 is an exemplary flowchart of a display correction method according to an embodiment of the present disclosure. The method may be used by a display correction system to correct display performance of a display. The display correction system according to the embodiment of the present disclosure may comprise an automatic adjustment apparatus and a light detection apparatus. The display correction method shown in FIG. 1 may comprise the following steps.

In step 101, the light detection apparatus acquires an optical signal emitted by the display, determines a first brightness value according to the optical signal, and transmits the first brightness value to the automatic adjustment apparatus.

When the display performance of the display is corrected using the display correction system according to the embodiment of the present disclosure, a communication connection is realized between the light detection apparatus and the automatic adjustment apparatus, and a communication connection is realized between the automatic adjustment apparatus and the display. It is desirable to place the light detection apparatus at a preset position on the display, for example, a center of a display screen of the display. However, the preset position is not specifically limited in the present disclosure.

After the display correction system is connected to the display, the display correction system is used to correct the display performance of the display. A test image is displayed by the display, an optical signal emitted by the display is acquired using the light detection apparatus, a first brightness value is determined according to the optical signal, and then the determined first brightness value is transmitted to the automatic adjustment apparatus.

In step 102, after determining that the first brightness value is different from a first standard brightness value preset for the display, the automatic adjustment apparatus adjusts the brightness value of the display to the first standard brightness value.

The first standard brightness value set for the display may be pre-stored in the display. When the brightness value of the display is the first standard brightness value, the brightness of the display is standard brightness, and the first standard brightness value may be stored in the display.

The automatic adjustment apparatus may receive the first brightness value transmitted by the light detection apparatus, and may also retrieve the first standard brightness value preset for the display from the display. Then, the automatic adjustment apparatus may compare the current brightness value of the display, that is, the first brightness value, with the standard brightness value preset for the display, that is, the first standard brightness value, and after determining that the first brightness value is different from the first standard brightness value, determine that the display is currently under non-standard brightness. At this time, the automatic adjustment apparatus may adjust the brightness value of the display to the first standard brightness value, so that the brightness of the display is standard brightness.

Before the automatic adjustment apparatus is used, the automatic adjustment apparatus may be initialized to remove legacy data, so as to prevent the legacy data from affecting a detection result.

In step 103, the automatic adjustment apparatus invokes a brightness sensor in the display to detect brightness of the display, and after determining that a second brightness value detected by the brightness sensor is different from a second standard brightness value preset for the brightness sensor, corrects the second standard brightness value of the brightness sensor to the second brightness value.

After adjusting the brightness of the display to the standard brightness, the automatic adjustment apparatus may transmit an instruction to the display to invoke the brightness sensor in the display to detect the brightness of the display. After receiving the instruction, the display may use the brightness sensor to detect the brightness, and then may transmit a second brightness value detected by the brightness sensor to the automatic adjustment apparatus.

The second standard brightness value preset for the brightness sensor is pre-stored in the display. In a process of performing this step, the automatic adjustment apparatus may retrieve the second standard brightness value from the display. After obtaining the second brightness value currently detected by the brightness sensor and the second standard brightness value preset for the brightness sensor, the automatic adjustment apparatus compares the second brightness value with the second standard brightness value, and after determining that the second brightness value is different from the second standard brightness value, determines that there is a problem with the brightness sensor in the display, and the detection result of the brightness sensor is inaccurate. At this time, the automatic adjustment apparatus may correct the second standard brightness value of the brightness sensor to the second brightness value. The corrected display uses the second brightness value in an operating state to control the display brightness of the display to be maintained at the standard brightness.

For example, a second standard brightness value of 100 preset for the brightness sensor is stored in the display, and after an adjustment operation of the automatic adjustment apparatus causes the display to be under standard brightness, if the automatic adjustment apparatus retrieves a second brightness value of 80 detected by the brightness sensor in the display, the automatic adjustment apparatus determines that there is a problem with the brightness sensor, and it needs to correct the second standard brightness value of the brightness sensor, and specifically correct the second standard brightness value of 100 of the brightness sensor in the display to the second brightness value of 80. The corrected display uses 80 in an operating state, to control the display brightness of the display to be maintained at the standard brightness.

According to the embodiment of the present disclosure, the second standard brightness value of the brightness sensor in the display is corrected using the light detection apparatus and the automatic adjustment apparatus. When the display is under the standard brightness, if the second brightness value detected by the brightness sensor is different from the second standard brightness value, the second standard brightness value of the brightness sensor is corrected to the second brightness value, and the corrected display uses the second brightness value in the operating state to control the display brightness of the display to be maintained at the standard brightness. The present disclosure effectively solves the problem that the display brightness of the display does not satisfy the requirements due to poor conditions such as aging of the brightness sensor, abnormalities of other devices etc., and the display is corrected periodically or non-periodically using the method according to the present disclosure, to ensure stable display of the display during a usage period.

Figure 2:
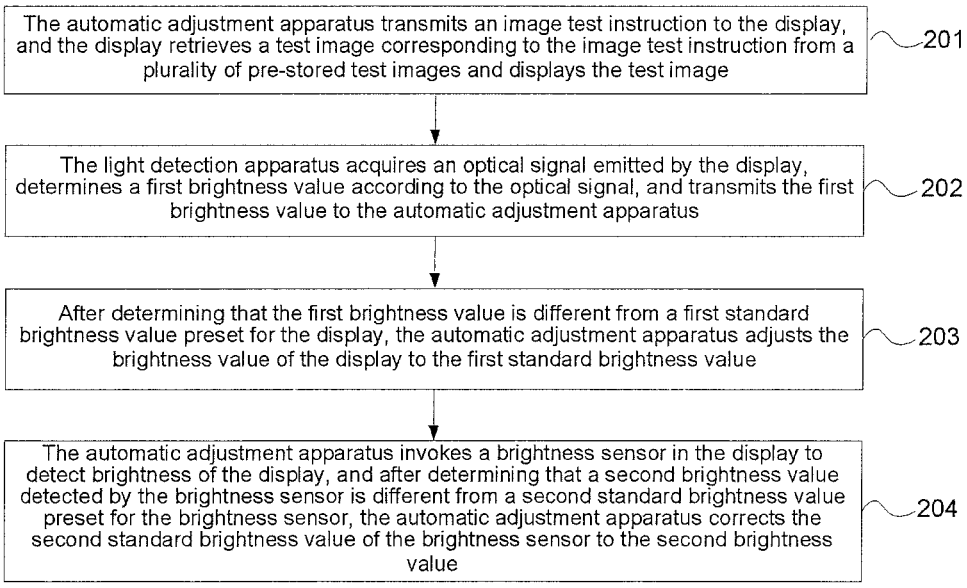
FIG. 2 is an exemplary flowchart of a display correction method according to another embodiment of the present disclosure.

FIG. 2 is a flowchart of a display correction method according to another embodiment of the present disclosure. The method may be applied when a display correction system corrects display performance of a display. The display correction system according to the embodiment of the present disclosure may comprise an automatic adjustment apparatus and a light detection apparatus. The display correction method shown in FIG. 2 may comprise the following steps.

In step 201, the automatic adjustment apparatus transmits an image test instruction to the display, and the display retrieves a test image corresponding to the image test instruction from a plurality of pre-stored test images and displays the test image.

Figure 3:
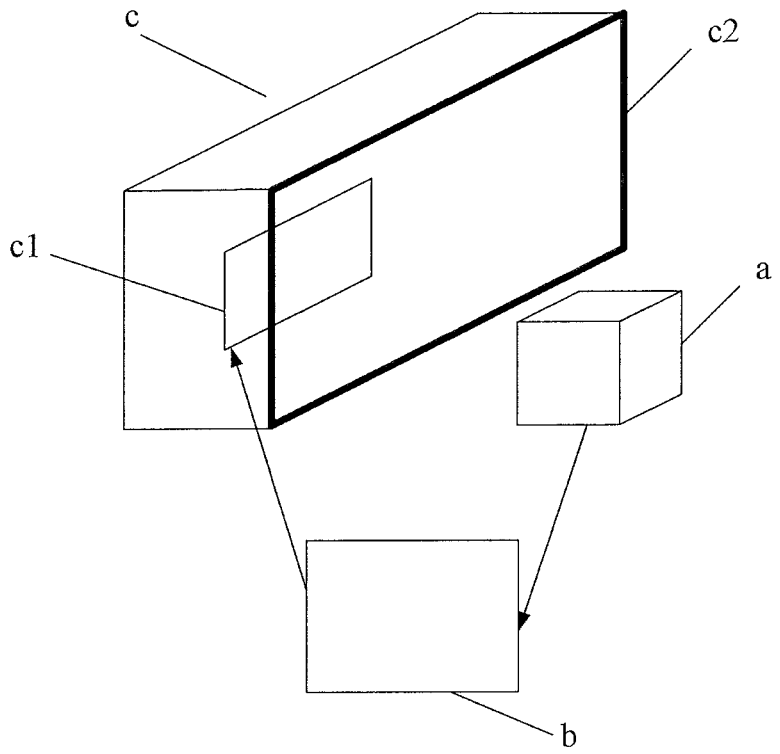
FIG. 3 is a schematic structural diagram of a display correction system when a display is corrected by the display correction system according to another embodiment of the present disclosure.

When the display performance of the display is corrected using the display correction system according to the embodiment of the present disclosure, a plurality of apparatuses and displays in the display correction system are firstly connected to each other. FIG. 3 is a schematic structural diagram of a display correction system according to an embodiment of the present disclosure. In FIG. 3, a is a light detection apparatus, b is an automatic adjustment apparatus, c is a display, c1 is a control panel of the display, and c2 is a display screen of the display. A connection relationship among the light detection apparatus a, the automatic adjustment apparatus b, and the display c may be as shown in FIG. 3. However, a connection relationship among various elements in the present disclosure is not limited thereto.

The control panel c1 in the display may be a System on Chip (SoC) control panel, the light detection apparatus a may be connected to the automatic adjustment apparatus b through an Inter-Integrated Circuit (IIC), and the automatic adjustment apparatus b may be connected to the control panel c1 in the display through the IIC. Since the IIC is a multi-directional control bus, a plurality of chips may be connected to the same bus structure, and at the same time, each of the chips may be used as a controller for real-time data transmission. Therefore, the connection method using the IIC simplifies bus interfaces for signal transmission. However, the chip connection method according to the present disclosure is not limited thereto.

After the display correction system is connected to the display, the display correction system is used to correct the display performance of the display. A plurality of test images, for example, test images at different grayscales, may be pre-stored in the display, the automatic adjustment apparatus may transmit an image test instruction to the display, and the display retrieves a corresponding test image according to the instruction and displays the test image on a display screen. The test image which is retrieved and displayed according to the image test instruction is preferably a test image at the highest grayscale. After the display screen displays the test image, the light detection apparatus is used to acquire an optical signal emitted by the display, determine a first brightness value according to the optical signal, and then transmit the determined first brightness value to the automatic adjustment apparatus.

In step 202, the light detection apparatus acquires an optical signal emitted by the display, determines a first brightness value according to the optical signal, and transmits the first brightness value to the automatic adjustment apparatus.

The light detection apparatus may comprise a light detection head and a colorimeter, and when the display performance of the display is corrected, the light detection head is connected to the colorimeter, and the light detection head is placed at a preset position of the display, for example, a center of the display screen of the display.

After the display displays the test image, the step of acquiring, by the light detection apparatus, the optical signal emitted by the display, determining the first brightness value of the optical signal, and transmitting the first brightness value to the automatic adjustment apparatus as described may be implemented by: acquiring, by the light detection head, the optical signal emitted by the display, and transmitting the acquired optical signal to the colorimeter, and then determining, by the colorimeter, the first brightness value of the optical signal, and transmitting the first brightness value to the automatic adjustment apparatus.

In step 203, after determining that the first brightness value is different from a first standard brightness value preset for the display, the automatic adjustment apparatus adjusts the brightness value of the display to the first standard brightness value.

The first standard brightness value set for the display may be pre-stored in the display. When the brightness value of the display is the first standard brightness value, the brightness of the display is standard brightness. The automatic adjustment apparatus may receive the first brightness value transmitted by the light detection apparatus, retrieve the first standard brightness value of the display from the display, and then compare the first brightness value with the first standard brightness value. After determining that the first brightness value is different from the first standard brightness value, the automatic adjustment apparatus determines that the display is currently in a non-standard brightness state, and may adjust the brightness value of the display to the first standard brightness value, so that the display is under standard brightness.

The display may further comprise a backlight stability control module and a backlight driving panel. The step of, after determining that the first brightness value is different from the first standard brightness value preset for the display, adjusting, by the automatic adjustment apparatus, the brightness value of the display to the first standard brightness value as described may be implemented by: after determining that the first brightness value is different from the first standard brightness value, the automatic adjustment apparatus controls the backlight stability control module in the display to adjust a duty cycle of a high-level pulse of the backlight driving panel or current of a backlight source, so that the brightness value of the display reaches the first standard brightness value. For example, when the automatic adjustment apparatus determines that a first brightness value of 110 is greater than a first standard brightness value of 100, the automatic adjustment apparatus may transmit an instruction to the backlight stability control module of the display to, for example, reduce the brightness value of the display from 110 to 100, and after receiving the instruction, the backlight stability control module may reduce the duty cycle of the high-level pulse of the backlight driving panel, so that the brightness of the display is reduced to the standard brightness.

In step 204, the automatic adjustment apparatus invokes a brightness sensor in the display to detect brightness of the display, and after determining that a second brightness value detected by the brightness sensor is different from a second standard brightness value preset for the brightness sensor, the automatic adjustment apparatus corrects the second standard brightness value of the brightness sensor to the second brightness value.

The second standard brightness value set for the brightness sensor may be pre-stored in the display, and the automatic adjustment apparatus may acquire the second brightness value detected by the brightness sensor while acquiring the second standard brightness value preset for the brightness sensor from the display. After determining that the second brightness value is different from the second standard brightness value, the automatic adjustment apparatus determines that there is a problem with the brightness sensor in the display, and a detection result of the brightness sensor is inaccurate. At this time, the automatic adjustment apparatus may correct the second standard brightness value of the brightness sensor to the second brightness value. The corrected display uses the second brightness value in an operating state to control the display brightness of the display to be maintained at the standard brightness.

In the embodiment of the present disclosure, the first standard brightness value set for the display and the second standard brightness value set for the brightness sensor may be stored in a standard brightness value storage module in the display, and may be extracted from the standard brightness value storage module when needed, or updated standard brightness values may be written into the standard brightness value storage module to correct the original standard brightness values.

Figure 4:
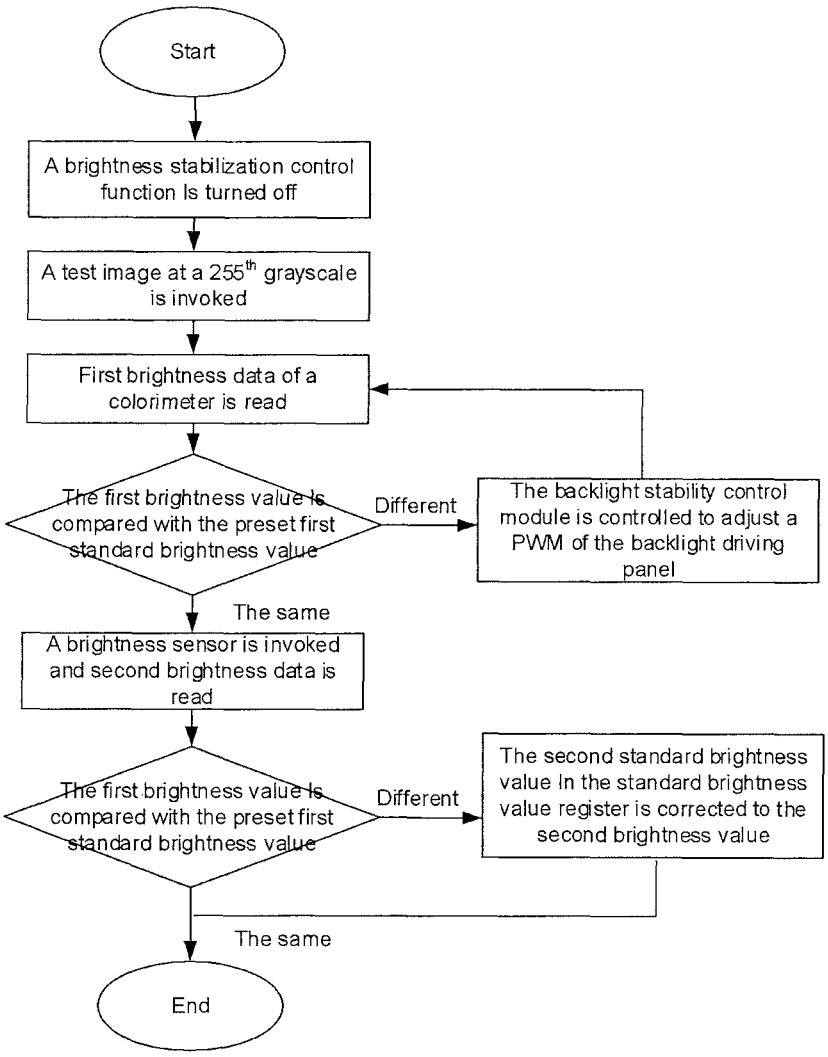
FIG. 4 is an exemplary block diagram of a display correction system when brightness of a display is corrected by the display correction system according to another embodiment of the present disclosure.

The above display correction method according to the embodiments of the present disclosure may be as shown in FIG. 4. In the method shown in FIG. 4, after display correction is started, a brightness stabilization control function may firstly be turned off, that is, the automatic adjustment apparatus transmits an instruction for stopping an operation of the backlight stability control module to the display, to stop the operation of the backlight stability control module. Then, a test image at the highest grayscale, i.e., a test image at a $255^{th}$ grayscale, is retrieved and displayed on the display. An optical signal emitted by the display is acquired using the light detection head, a first brightness value of the optical signal is determined using the colorimeter, and data of the colorimeter is read. The automatic adjustment apparatus compares the first brightness value with the preset first standard brightness value, and if the first brightness value is different from the preset first standard brightness value, controls the backlight stability control module to adjust a PWM of the backlight driving panel, until the display is adjusted to the standard brightness. The automatic adjustment apparatus compares the first brightness value with the preset first standard brightness value, and if the first brightness value is the same as the preset first standard brightness value, invokes the brightness sensor in the display to detect and acquire a second brightness value. If it is determined that the second brightness value is different from a preset second standard brightness value, the automatic adjustment apparatus writes the detected second brightness value into a standard brightness value register in the display, and corrects the second standard brightness value to the second brightness value. Then, the correction process ends. It should be illustrated that the steps of the above method are merely used for illustration, instead of limiting the scope of the present disclosure. In other words, the method may comprise additional steps, or may not comprise some of the above steps, or some of the above steps may be replaced with other steps.

After the standard brightness value of the brightness sensor in the display has been corrected, the method according to the embodiments of the present disclosure may further perform Gamma testing and Gamma correction on the display to improve the display performance of the display. Specifically, after the second standard brightness value of the brightness sensor is corrected to the second brightness value, the method may further comprise: acquiring, by the light detection apparatus, optical signals emitted by the display when test images at various grayscales are displayed by the display, and determining corresponding brightness values according to various optical signals; and performing, by the automatic adjustment apparatus, Gamma testing and Gamma correction on the display according to the brightness values corresponding to the test images at various grayscales transmitted by the light detection apparatus.

Figure 5:
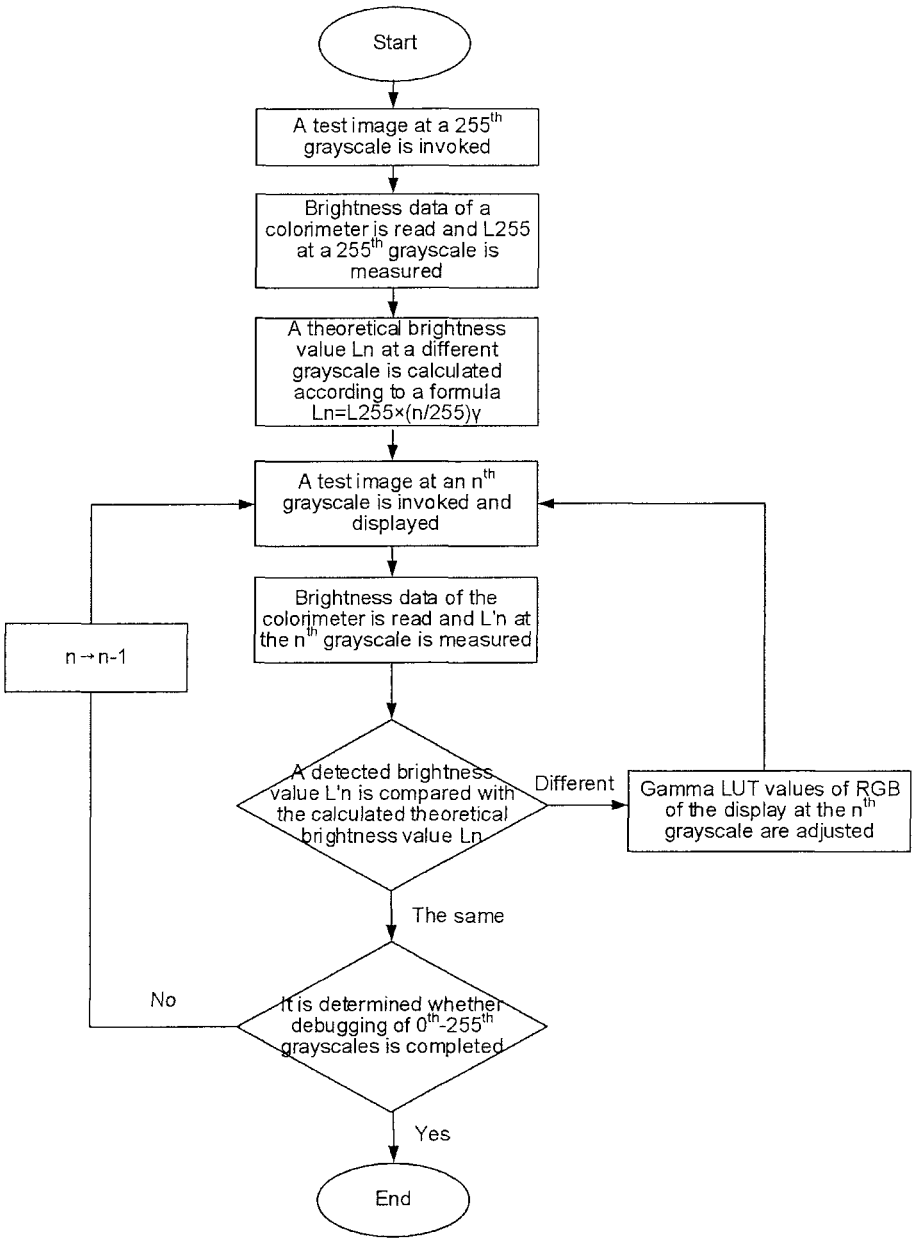
FIG. 5 is a block diagram of a method for performing Gamma testing and correction on a display by a display correction system according to another embodiment of the present disclosure.

FIG. 5 is a flowchart of a method for performing Gamma testing and Gamma correction on a display according to an embodiment of the present disclosure. As shown in FIG. 5, the method for performing Gamma testing and Gamma correction on a display may comprise the following steps. In a first step, a test image at a $255^{th}$ grayscale is retrieved and displayed on the display. In a second step, an optical signal emitted by the display is acquired using the light detection head, a brightness value of the optical signal is determined using the colorimeter, and data of the colorimeter is read. In a third step, a theoretical brightness value $L_n$ at a different grayscale is calculated according to a formula $L_n=L_{255}\times(n/255)\gamma$, wherein $\gamma$ is a Gamma parameter, which is generally 2.2, and may also be 1.8, 2.0, 2.4, etc. for some displays (however, the present disclosure is not limited to these specific values); n is a grayscale number; $L_{255}$ is a brightness value at the $255^{th}$ grayscale; and $L_n$ is a theoretical brightness value at an $n^{th}$ grayscale. In a fourth step, a test image at the $n^{th}$ grayscale is retrieved and displayed. In a fifth step, a brightness value of the test image at the $n^{th}$ grayscale is detected using the light detection head and the colorimeter. In a sixth step, for the test image at the $n^{th}$ grayscale, a detected brightness value $L'_n$ is compared with the calculated theoretical brightness value $L_n$, if the detected brightness value $L'_n$ is the same as the calculated theoretical brightness value $L_n$, then the process proceeds to a seventh step; and if the detected brightness value $L'_n$ is different from the calculated theoretical brightness value $L_n$, grayscale values (Gamma LUT values) of three sub-pixels of the display, which are R (Red), G (Green) and B (Blue), at the $n^{th}$ grayscale are adjusted, then the test image at the $n^{th}$ grayscale is displayed on the display, and the fourth step to the sixth step are repeated until the detected brightness value at the $n^{th}$ grayscale is the same as the calculated theoretical brightness value. In a seventh step, it is determined whether debugging of $0^{th}$-$255^{th}$ grayscales is completed, and if the debugging is completed, the process ends, and if the debugging is not completed, the process proceeds to an eighth step. In the eighth step, the current grayscale number is reduced by 1, to obtain an $(n-1)^{th}$ grayscale, a test image at the $(n-1)^{th}$ grayscale is retrieved and displayed, and the fourth step to the seventh step are repeated, until the Gamma testing and Gamma correction are completed for the 0th-$255^{th}$ grayscales.

After the standard brightness value of the brightness sensor in the display has been corrected, the method according to the embodiments of the present disclosure may further perform color temperature testing and color temperature correction on the display to improve the display performance of the display. Specifically, after the second standard brightness value of the brightness sensor is corrected to the second brightness value, the method may further comprise: acquiring, by the light detection apparatus, optical signals emitted by the display when test images at various grayscales are displayed by the display, and determining corresponding color data according to various optical signals; and performing, by the automatic adjustment apparatus, color temperature testing and color temperature correction on the display according to the color data corresponding to the test images at various grayscales transmitted by the light detection apparatus.

Figure 6:
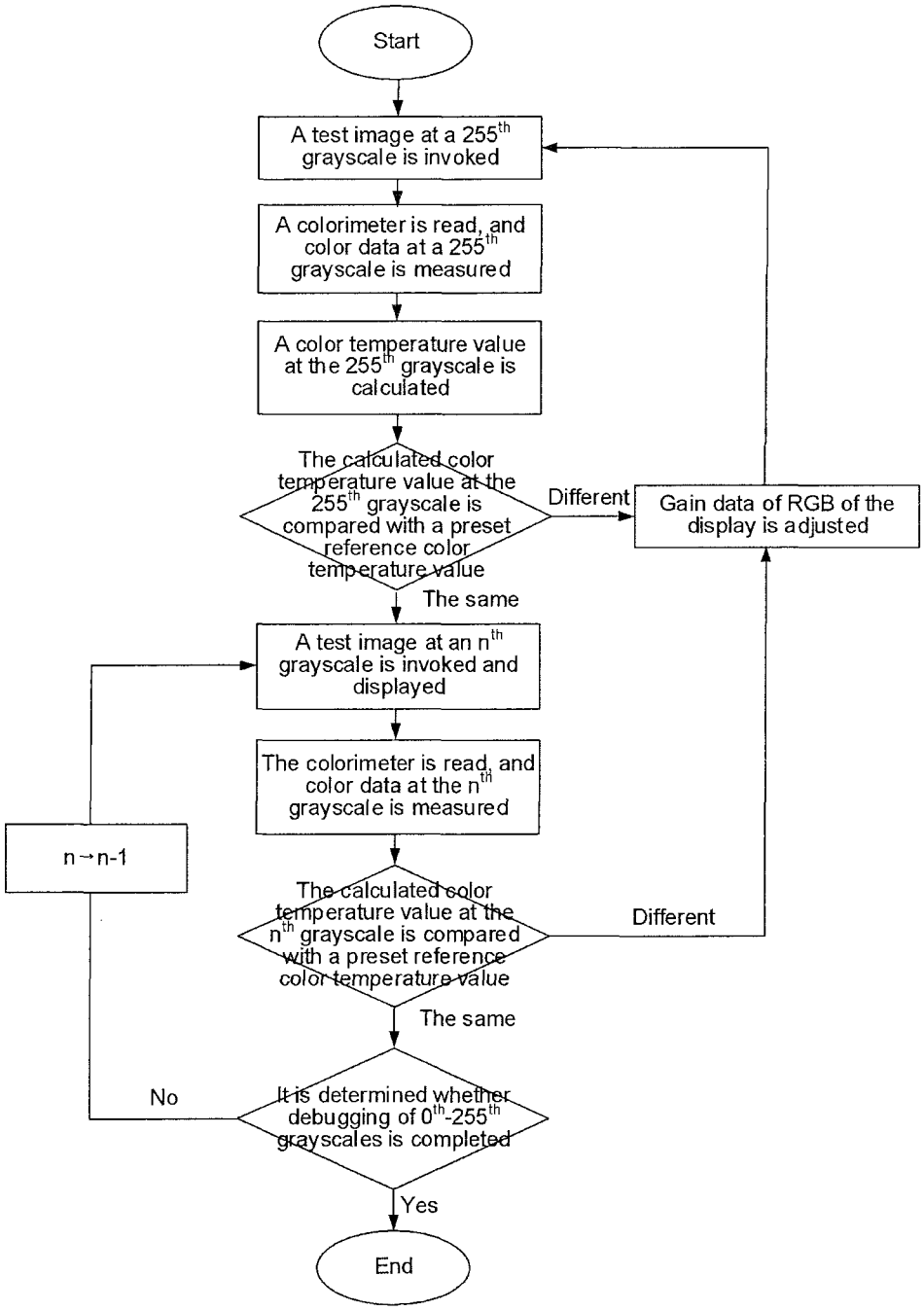
FIG. 6 is a block diagram of a method for performing color temperature testing and correction on a display by a display correction system according to another embodiment of the present disclosure.

FIG. 6 is a flowchart of a method for performing color temperature testing and color temperature correction on a display according to an embodiment of the present disclosure. As shown in FIG. 6, the method for performing color temperature test and color temperature correction on a display may comprise the following steps. In a first step, a test image at a $255^{th}$ grayscale is retrieved and displayed on the display. In a second step, an optical signal emitted by the display is acquired using the light detection head, and color data of the optical signal is determined using the colorimeter. In a third step, a color temperature value at the $255^{th}$ grayscale is calculated according to the determined color data. In a fourth step, the calculated color temperature value at the $255^{th}$ grayscale is compared with a preset reference color temperature value. In a fifth step, when the calculated color temperature value at the $255^{th}$ grayscale is different from the preset reference color temperature value, color gain coefficients of three sub-pixels of the display, which are RGB, are adjusted. In a sixth step, after the adjustment is completed, the test image at the $255^{th}$ grayscale is displayed on the display, and the second step to the fifth step are repeated, until a color temperature value which is calculated in a case of the test image at the $255^{th}$ grayscale is the same as the preset reference color temperature value. In a seventh step, when the calculated color temperature value at the $255^{th}$ grayscale is the same as the preset reference color temperature value, test images at other n grayscales are retrieved in turn, and the second step to the sixth step are performed, until the color temperature testing and the color temperature correction at $0^{th}$-$255^{th}$ grayscales are completed. When color temperatures at various grayscales are tested and corrected, the same reference color temperature value is used.

When a color temperature is calculated, a color temperature value CCT at a certain grayscale may be calculated according to color data, i.e., color coordinates ($w_x$, $w_y$), at the grayscale obtained by the colorimeter using the following calculation formula:

$$N=(w_x-0.332)/(0.1858-w_y)$$

$$CCT=437\times N^3+3601\times N^2+6831\times N+5517$$

After the standard brightness value of the brightness sensor in the display is corrected in an operation, the Gamma correction and the color temperature correction may be performed on the display using the grayscale-by-grayscale correction method. Specifically, in some embodiments, a brightness value and color data at an $n^{th}$ grayscale may be read from the colorimeter at the same time. Gamma testing and Gamma correction at the $n^{th}$ grayscale are performed firstly on the display, and then color temperature testing and color temperature correction at the $n^{th}$ grayscale are performed on the display. Then, a brightness value and color data at an $(n-1)^{th}$ grayscale are read from the colorimeter. Gamma testing and Gamma correction at the $(n-1)^{th}$ grayscale are performed firstly on the display, and then color temperature testing and color temperature correction at the $(n-1)^{th}$ grayscale are performed on the display. Finally, correction at each grayscale has been performed on the display, thereby improving the display performance of the display and ensuring stable display of the display during a usage period.

According to the embodiments of the present disclosure, the second standard brightness value of the brightness sensor in the display is corrected using the light detection apparatus and the automatic adjustment apparatus. When the display is under the standard brightness, if the second brightness value detected by the brightness sensor is different from the second standard brightness value, the second standard brightness value of the brightness sensor is corrected to the second brightness value, and the corrected display uses the second brightness value in an operating state to control the display brightness of the display to be maintained at the standard brightness. The present disclosure effectively solves the problem that the display brightness of the display does not satisfy the requirements due to poor conditions such as aging of the brightness sensor, abnormalities of other devices etc., and the display is corrected periodically or non-periodically using the method according to the present disclosure, to ensure stable display of the display during a usage period. The display correction method according to the present disclosure may further perform Gamma testing and Gamma correction as well as color temperature testing and color temperature correction on the display, and the above testing and correction processes further adjust and improve the performance of the display.

The embodiments of the present disclosure provide a display correction system which corrects display performance of a display using the display correction method described in the above embodiments. A structure of the display correction system is as shown in FIG. 3, and the display correction system comprises an automatic adjustment apparatus and a light detection apparatus.

Here, the light detection apparatus is placed at a preset position of the display, and is configured to acquire an optical signal emitted by the display, determine a first brightness value according to the optical signal, and transmit the first brightness value to the automatic adjustment apparatus.

The automatic adjustment apparatus is configured to, after determining that the first brightness value is different from the first standard brightness value preset for the display, adjust the brightness value of the display to the first standard brightness value; and invoke a brightness sensor in the display to detect brightness of the display, and after determining that the second brightness value detected by the brightness sensor is different from a second standard brightness value preset for the brightness sensor, correct the second standard brightness value of the brightness sensor to the second brightness value. The corrected display uses the second brightness value in an operating state, to control the display brightness of the display to be maintained at the standard brightness.

When the display is corrected using the display correction system according to the embodiment of the present disclosure, the standard brightness value of the brightness sensor in the display may be corrected, so that the brightness of the display which is adjusted according to the brightness value detected by the brightness sensor is maintained at the standard brightness of the display.

In some embodiments, the light detection apparatus may comprise a light detection head and a colorimeter, wherein the light detection head is configured to acquire an optical signal emitted by the display, and transmit the acquired optical signal to the colorimeter, and the colorimeter is configured to determine a first brightness value of the optical signal and transmit the first brightness value to the automatic adjustment apparatus. The light detection head may be placed at a center of a display screen of the display.

In some embodiments, before the optical signal is acquired using the light detection apparatus, the automatic adjustment apparatus may transmit an image test instruction to an instruction register in the display, and the display retrieves a required test image from a plurality of pre-stored test images according to the image test instruction, and displays the test image on the display for the light detection apparatus to acquire the optical signal. The plurality of test images pre-stored in the display may be test images at different grayscales, and a test image displayed on the display may be a test image at the highest grayscale.

In some embodiments, the display may further comprise a backlight stability control module and a backlight driving panel. After determining that the first brightness value is different from the first standard brightness value, the automatic adjustment apparatus may control the backlight stability control module in the display to adjust a duty ratio of a high-level pulse of the backlight driving panel, so that the brightness value of the display screen reaches the first standard brightness value. For example, after the automatic adjustment apparatus determines that the first brightness value is less than the first standard brightness value, the duty ratio of the high-level pulse of the backlight driving panel may be increased, thereby increasing the brightness of the display.

In some embodiments, the display may further comprise a standard brightness value memory, wherein the second standard brightness value of the brightness sensor and the first standard brightness value of the display may be stored in the standard brightness value memory, and the standard brightness values may be retrieved from the standard brightness value memory when the standard brightness values are to be used. At this time, the automatic adjustment apparatus may read the second standard brightness value set for the brightness sensor from the standard brightness value memory of the display, and after determining that the second brightness value detected by the brightness sensor is different from the second standard brightness value, replace the second standard brightness value in the standard brightness value memory with the second brightness value.

In some embodiments, the light detection apparatus is further configured to acquire optical signals emitted by the display when test images at various grayscales are displayed by the display, and determine corresponding brightness values and color data according to various optical signals.

The automatic adjustment apparatus may comprise a Gamma correction unit and a color temperature correction unit, and has a Gamma correction function and a color temperature correction function accordingly. The Gamma correction unit performs Gamma testing and Gamma correction on the display after receiving the brightness values corresponding to the test images at various grayscales transmitted by the light detection apparatus; and after receiving color data corresponding to the test images at various grayscales transmitted by the light detection apparatus, the color temperature correction unit performs color temperature testing and color temperature correction on the display.

In some embodiments, the automatic adjustment apparatus may further comprise a test program storage module, and a plurality of test programs may be pre-stored in the test program storage module. After the automatic adjustment apparatus has performed the testing and the correction on the display, the automatic adjustment apparatus may invoke the test programs stored in the test program storage module to perform testing on the display performance of the display. After the program tests are passed, the automatic adjustment apparatus determines that the corrected display has good display performance and may be used with confidence.

In some embodiments, the automatic adjustment apparatus according to the embodiments of the present disclosure may be mounted in the display. Specifically, the programs of the automatic adjustment apparatus are integrated on a control panel in the display, for example, a Microcontroller Unit (MCU) system integrated in an SoC of the display, and the light detection apparatus such as a colorimeter may be connected to an IIC interface in the display through an IIC bus. The automatic adjustment apparatus may also be a separate apparatus independent of the display, for example, a desktop computer or a notebook computer installed with automatic adjustment programs, a single-chip microcomputer provided with an MCU, etc.

Figure 7:
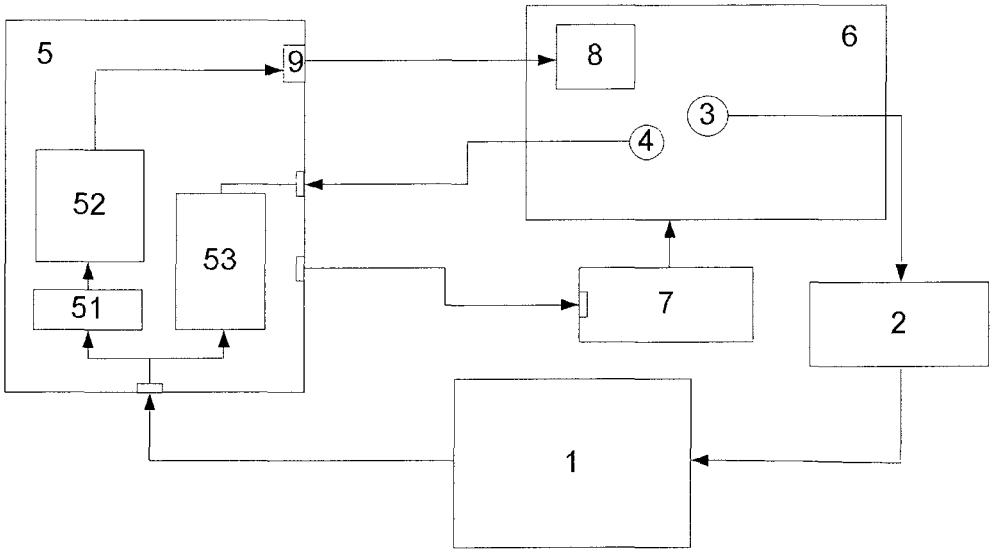
FIG. 7 is a schematic structural diagram of a display correction system when a display is corrected by the display correction system according to another embodiment of the present disclosure.

FIG. 7 is a schematic structural diagram of a display correction system when a display is corrected by the display correction system according to another embodiment of the present disclosure. A structure of the display correction system and an exemplary connection structure of the display correction system and the display according to the embodiments of the present disclosure will be described in detail by using the structure shown in FIG. 7.

As shown in FIG. 7, the display correction system comprises an automatic adjustment apparatus 1, a colorimeter 2, and a light detection head 3. The display comprises a brightness sensor 4, an SOC control panel 5, a display panel 6, and a backlight driving panel 7. The SOC control panel 5 comprises an instruction register 51, a test image memory 52 and a backlight stability control module 53. The display panel 6 has a Timing Controller Board (TCON) 8 disposed thereon.

The brightness sensor 4 is disposed at a preset position of the display panel 6, for example, a position near a light-emitting surface of an LED backlight source, inner walls of a panel frame of the display panel 6, and the brightness sensor 4 is connected to the backlight stability control module 53 in the SOC control panel 5 via lines. The backlight stability control module 53 is connected to the backlight driving panel 7 via lines, the automatic adjustment apparatus 1 is connected to the instruction register 51 and the backlight stability control module 53 through the SOC control panel 5 via lines respectively, a communication connection is realized between the instruction register 51 and the test image memory 52, and the test image memory 52 is connected to the timing control board 8 of the display through a high speed interface 9 of the SOC control panel 5. The light detection head 3 may be placed at a center of the display panel 6, the colorimeter 2 is connected to the automatic adjustment apparatus 1 via lines, and the automatic adjustment apparatus 1 is connected to the SOC control panel 4 of the display via lines. Connection lines used between different apparatuses or modules may be, but are not limited to, IIC buses.

The present disclosure provides a display correction method and a display correction system. The method may be used by the display correction system to correct the display performance of the display. The display correction system comprises an automatic adjustment apparatus and a light detection apparatus, and the second standard brightness value of the brightness sensor in the display is corrected using the light detection apparatus and the automatic adjustment apparatus. When the display is under the standard brightness, if the second brightness value detected by the brightness sensor is different from the second standard brightness value, the second standard brightness value of the brightness sensor is corrected to the second brightness value, and the corrected display uses the second brightness value in an operating state to control the brightness of the display to be maintained at the standard brightness. The present disclosure effectively solves the problem that the display brightness of the display does not satisfy the requirements due to poor conditions such as aging of the brightness sensor, abnormalities of other devices etc., and the display is corrected periodically or non-periodically using the method according to the present disclosure, to ensure stable display of the display during a usage period.

The display correction method according to the present disclosure may further perform Gamma testing and Gamma correction as well as color temperature testing and color temperature correction on the display, and the above testing and correction processes further adjust and improve the performance of the display.

The same or similar parts among various embodiments in this specification may be referred to each other. In other words, some or all of various features described in various embodiments of the present disclosure may be combined to form a new embodiment without conflict with each other, or some of the features may be removed to form a new embodiment.

The display correction method and the display correction system according to the present disclosure are described in detail above. The principles and implementations of the present disclosure are described herein by using specific examples. The above description of the embodiments is only for facilitating understanding the method according to the present disclosure and core ideas thereof. At the same time, there will be changes in the specific implementations and the application scope thereof for those skilled in the art according to the ideas of the present disclosure. In conclusion, the contents of the present specification should not be construed as limiting the present disclosure.

I claim:

1. A display correction method for correcting display performance of a display by a display correction system, the display correction system comprising an automatic adjustment apparatus and a light detection apparatus, the method comprising:

acquiring, by the light detection apparatus, an optical signal emitted by the display, determining a first brightness value according to the optical signal, and transmitting the first brightness value to the automatic adjustment apparatus;

in response to determining that the first brightness value is different from a first standard brightness value preset for the display, adjusting, by the automatic adjustment apparatus, the brightness value of the display to the first standard brightness value;

triggering, by the automatic adjustment apparatus, a brightness sensor in the display to detect brightness of the display, and in response to determining that a second brightness value detected by the brightness sensor is different from a second standard brightness value preset for the brightness sensor, correcting the second standard brightness value of the brightness sensor to the second brightness value.

2. The method according to claim 1, wherein the display further comprises a backlight stability control module and a backlight driving panel, and the step of, in response to determining that the first brightness value is different from the first standard brightness value preset for the display, adjusting, by the automatic adjustment apparatus, a brightness value of the display to the first standard brightness value comprises:

in response to determining that the first brightness value is different from the first standard brightness value, controlling, by the automatic adjustment apparatus, the backlight stability control module in the display to adjust a duty ratio of a high-level pulse of the backlight driving panel or current of a backlight source, so that the brightness value of the display reaches the first standard brightness value.

3. The method according to claim 1, wherein after the second standard brightness value of the brightness sensor is corrected to the second brightness value, the method further comprises:

acquiring, by the light detection apparatus, optical signals emitted by the display when test images at various grayscales are displayed by the display, and determining corresponding brightness values according to various optical signals; and performing, by the automatic adjustment apparatus, Gamma testing and Gamma correction on the display according to the brightness values corresponding to the test images at various grayscales transmitted by the light detection apparatus.

4. The method according to claim 1, wherein after the second standard brightness value of the brightness sensor is corrected to the second brightness value, the method further comprises:

acquiring, by the light detection apparatus, optical signals emitted by the display when test images at various grayscales are displayed by the display, and determining corresponding color data according to various optical signals; and performing, by the automatic adjustment apparatus, color temperature testing and color temperature correction on the display according to the color data corresponding to the test images at various grayscales transmitted by the light detection apparatus.

5. The method according to claim 1, wherein the light detection apparatus comprises a light detection head and a colorimeter; and the step of acquiring, by the light detection apparatus, an optical signal emitted by the display, determining a first brightness value according to the optical signal, and transmitting the first brightness value to the automatic adjustment apparatus comprises:

acquiring, by the light detection head, the optical signal emitted by the display, and transmitting the acquired optical signal to the colorimeter; and determining, by the colorimeter, the first brightness value of the optical signal and transmitting the first brightness value to the automatic adjustment apparatus.

6. The method according to claim 5, wherein the light detection head is placed at a center of a display screen of the display.

7. The method according to claim 1, wherein before the light detection apparatus acquires the optical signal emitted by the display, the method further comprises:

transmitting, by the automatic adjustment apparatus, an image test instruction to the display, and retrieving, by the display, a test image corresponding to the image test instruction from a plurality of pre-stored test images and displaying the test image.

8. The method according to claim 7, wherein the test image which is retrieved and displayed according to the image test instruction is a test image at the highest grayscale.

9. The method according to claim 1, wherein before, in response to determining that a second brightness value detected by the brightness sensor is different from a second standard brightness value preset for the brightness sensor, correcting the second standard brightness value of the brightness sensor to the second brightness value, the method further comprises:

receiving, from the display, the second standard brightness value set for the brightness sensor which is stored in a standard brightness value memory of the display.

10. The method according to claim 9, wherein the step of, in response to determining that a second brightness value detected by the brightness sensor is different from a second standard brightness value preset for the brightness sensor, correcting the second standard brightness value of the brightness sensor to the second brightness value comprises:

in response to determining that the second brightness value detected by the brightness sensor is different from the second standard brightness value, triggering the display to replace the second standard brightness value stored in the standard brightness value memory with the second brightness value.

11. A display correction system for correcting display performance of a display, the display correction system comprising an automatic adjustment apparatus and a light detection apparatus, wherein the light detection apparatus is placed at a preset position of the display, and is configured to acquire an optical signal emitted by the display, determine a first brightness value according to the optical signal, and transmit the first brightness value to the automatic adjustment apparatus; and the automatic adjustment apparatus is communicatively connected to the light detection apparatus, and is configured to :

in response to determining that the first brightness value is different from a first standard brightness value preset for the display, adjust the brightness value of the display to the first standard brightness value;

trigger a brightness sensor in the display to detect brightness of the display, and in response to determining that a second brightness value detected by the brightness sensor is different from a second standard brightness value preset for the brightness sensor, correct the second standard brightness value of the brightness sensor to the second brightness value.

12. The display correction system according to claim 11, wherein the display further comprises a backlight stability control module and a backlight driving panel, and the automatic adjustment apparatus is configured to:

in response to determining that the first brightness value is different from the first standard brightness value, control the backlight stability control module in the display to adjust a duty ratio of a high-level pulse of the backlight driving panel or current of a backlight source, so that the brightness value of a display screen reaches the first standard brightness value.

13. The display correction system according to claim 11, wherein the automatic adjustment apparatus is configured to:

receive, from the display, the second standard brightness value set for the brightness sensor which is stored in a standard brightness value memory of the display, and in response to determining that the second brightness value detected by the brightness sensor is different from the second standard brightness value, trigger the display to replace the second standard brightness value stored in the standard brightness value memory with the second brightness value.

14. The display correction system according to claim 11, wherein the light detection apparatus is further configured to acquire optical signals emitted by the display when test images at various grayscales are displayed by the display, and determine corresponding brightness values according to various optical signals; and the automatic adjustment apparatus comprises a Gamma correction unit, wherein the Gamma correction unit is configured to perform Gamma testing and Gamma correction on the display in response to receiving the brightness values corresponding to the test images at various grayscales transmitted by the light detection apparatus.

15. The display correction system according to claim 14, wherein the automatic adjustment apparatus further comprises a test program storage module, wherein the automatic adjustment apparatus is configured to: in response to that the automatic adjustment apparatus has performed the testing and the correction on the display, invoke test programs stored in the test program storage module to perform testing on the display performance of the display.

16. The display correction system according to claim 11, wherein the light detection apparatus comprises a light detection head and a colorimeter, wherein the light detection head is configured to acquire an optical signal emitted by the display, and transmit the acquired optical signal to the colorimeter; and the colorimeter is configured to determine a first brightness value of the optical signal and transmit the first brightness value to the automatic adjustment apparatus.

17. The display correction system according to claim 16, wherein the light detection head is placed at a center of the display screen of the display.

18. The display correction system according to claim 11, wherein the automatic adjustment apparatus transmits an image test instruction to an instruction register in the display, and the display retrieves a required test image from a plurality of pre-stored test images and displays the test image on the display.

19. The display correction system according to claim 11, wherein the automatic adjustment apparatus is mounted in the display.

20. The display correction system according to claim 11, wherein the light detection apparatus is further configured to acquire optical signals emitted by the display when test images at various grayscales are displayed by the display, and determine corresponding color data according to various optical signals; and the automatic adjustment apparatus comprises a color temperature correction unit, wherein the color temperature correction unit is configured to perform color temperature testing and color temperature correction on the display in response to receiving the color data corresponding to the test images at various grayscales transmitted by the light detection apparatus.

* * * * *